United States Patent [19]

Takahashi et al.

[11] Patent Number: 4,881,764

[45] Date of Patent: Nov. 21, 1989

[54] LOCKING DEVICE

[75] Inventors: Atsushi Takahashi, Fujisawa; Haruhiko Watari, Tokyo, both of Japan

[73] Assignee: Nifco Inc., Yokohama, Japan

[21] Appl. No.: 235,176

[22] Filed: Aug. 22, 1988

[30] Foreign Application Priority Data

Aug. 27, 1987 [JP] Japan ..... 62-129173[U]

[51] Int. Cl.[4] ..... E05C 19/06

[52] U.S. Cl. ..... 292/13; 292/17; 292/76; 292/91; 292/DIG. 38; 403/71; 403/406.1

[58] Field of Search ..... 292/17, 91, DIG. 4, 292/DIG. 38, 13, 76, 19, 20, 87; 403/71, 406.1

[56] References Cited

U.S. PATENT DOCUMENTS

| | | | |
|---|---|---|---|
| 66,591 | 7/1867 | Huddart | 292/17 |
| 389,605 | 9/1888 | Shaw et al. | 292/17 |
| 432,867 | 7/1890 | Fishel et al. | 292/17 |
| 661,460 | 11/1900 | Tefft et al. | 292/17 |
| 859,459 | 7/1907 | McCauley | 292/17 |
| 2,169,691 | 8/1939 | Hammer | 292/76 X |
| 2,263,554 | 11/1941 | Brach | 292/17 X |
| 2,493,624 | 1/1950 | Gerson | 292/17 |
| 3,061,346 | 10/1962 | Jorgensen | 292/DIG. 38 X |
| 3,221,439 | 12/1965 | Schaper | 403/406.1 |
| 3,466,075 | 9/1969 | Fernandez et al. | 292/DIG. 38 X |
| 4,322,914 | 4/1982 | McGaughey | 292/DIG. 38 X |

FOREIGN PATENT DOCUMENTS

| | | | |
|---|---|---|---|
| 521810 | 3/1931 | Fed. Rep. of Germany | 403/71 |
| 3527211 | 2/1987 | Fed. Rep. of Germany | 292/91 |
| 730916 | 5/1932 | France | 292/17 |
| 2160255 | 12/1985 | United Kingdom | 292/DIG. 38 |

*Primary Examiner*—Lloyd A. Gall
*Attorney, Agent, or Firm*—Richard Bushnell

[57] ABSTRACT

A locking device includes a striker and a latch. The striker projects from the back side of an openable wall which is hinged on a housing. The latch is secured to the edge of an opening of the housing so that it faces the striker for engaging with and holding the striker in a snap-engaged state when the openable wall is closed. The latch is rotatably mounted in the housing so that the rotation thereof follows the direction of insertion of the striker into the latch.

4 Claims, 3 Drawing Sheets

LOCKING DEVICE

BACKGROUND OF THE INVENTION

1. Field of the Invention

This invention relates to a locking device which consists of a combination of a latch and a striker and serves to lock an openable wall of a piece of furniture or electric apparatus, or a lid or like openable wall for closing an opening of a container.

2. Prior Art Statement

As for the locking devices of this type, there can be cited those disclosed in U.S. Pat. Nos. 4,616,861, 4,657,291 and 4,709,949, for example. The prior art locking devices consist of a combination of a striker projecting from the back side of an openable wall hinged to a housing and a latch secured to the edge of an opening of the housing in a face-to-face relation to the striker for engaging with the striker and snappingly holding the striker when the openable wall is closed.

In the prior art locking devices, however, if the hinged point of the openable wall is comparatively close to the striker, the radius of rotation of the striker when the openable wall is opened and closed is small, so that the striker enters the latch obliquely.

For this reason, undesirable distortion or twist is produced in the latch, and the striker is liable to be erroneously latched when the openable wall is closed suddenly or quickly.

OBJECT AND SUMMARY OF THE INVENTION

An object of the invention is to provide a locking device which permits smooth engagement between a striker and a latch, is free from erroneous latching of the striker and is highly reliable even if the hinged point of the openable wall is close to the striker.

In order to attain the above object, there is provided a locking device in which a latch is mounted in a housing such that it is rotatable relative to the housing with the rotation following the insertion of a striker into it.

Thus, according to the invention, even if the striker is inserted obliquely into the latch, deviation of the insertion direction can be compensated for by a rotation of the latch relative to the housing, so that the striker can be reliably snapped.

The above and other objects and features of the invention will become more apparent from the following detailed description with reference to the accompanying drawings.

DETAILED DESCRIPTION OF THE PREFERRED EMBODIMENT

Figure 1:
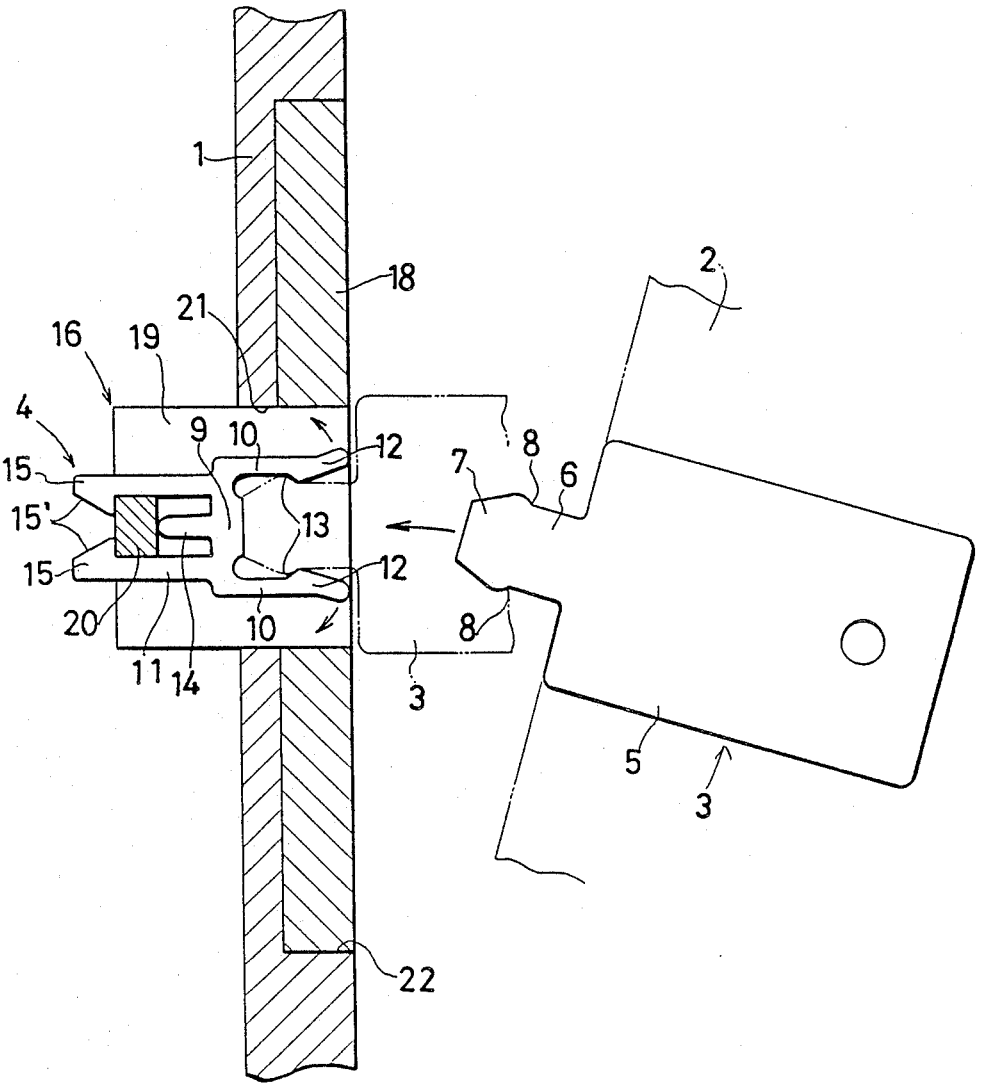
FIG. 1 is a side view showing an embodiment of the locking device according to the invention with a striker facing a latch mounted in a housing.
Figure 2:
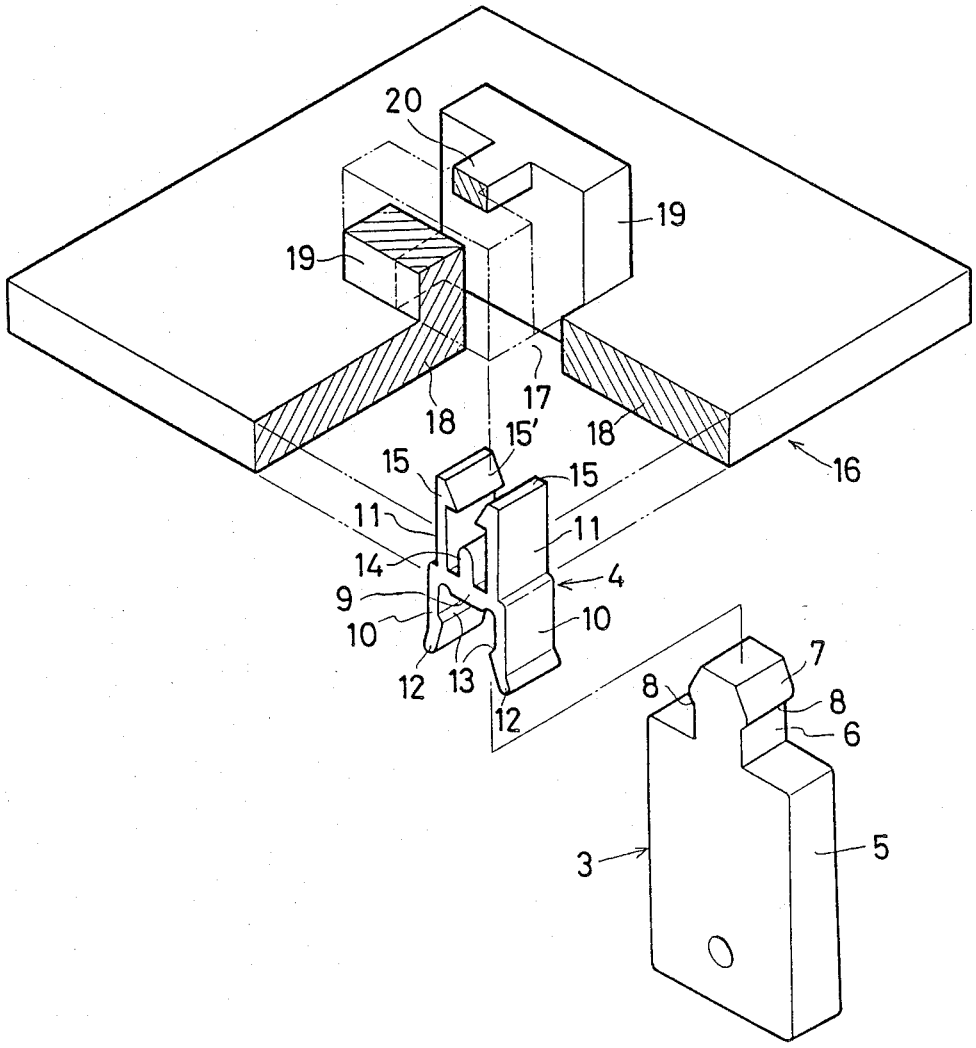
FIG. 2 is a perspective view showing the locking device shown in FIG. 1 in an exploded state.
Figure 3:
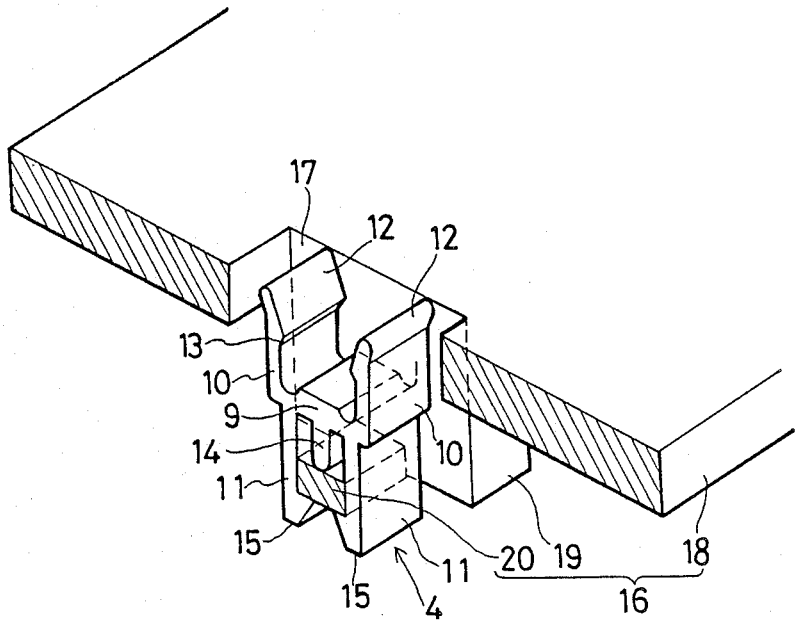
FIG. 3 is a perspective view showing a latch of the locking device shown in FIG. 1 in a state mounted in a mounting frame.

The drawings illustrate an embodiment of the locking device according to the invention. In the drawings, reference numeral 1 designates a box-like housing having a front opening (not shown) numeral 2 a door serving as an openable wall for opening and closing the housing 1, numeral 3 a striker projecting from the back side of the door 2 toward the housing 1, and numeral 4 a latch which is secured to the edge of the opening of the housing 1 in a face-to-face relation to the striker 3, and into which the striker 3 is inserted to be snap-engaged when the door 2 is closed.

The striker 3 includes a base portion 5 mounted on the door 2 and a projecting portion 6 projecting from one end of the base portion 5. The striker 3 is a one-piece molding of a resin having comparatively high rigidity, i.e., ABS (acrylonitrile-butadiene-styrene). The projecting portion 6 has a laterally projecting head-like end portion 7 having a trapezoidal sectional profile. The end portion 7 has obliquely rearwardly slanted lock shoulders 8 formed at its stem.

The latch 4 is substantially H-shaped and has a central coupling portion 9, a pair of (first) opposite side arm portions 10 extending forwardly and substantially parallel to each other from the opposite ends of the coupling portion 9 such that the striker 3 can be snapped between these arm portions 10 and also has a pair of opposite side support leg portions (second arm portions) 11 extending rearwardly and substantially parallel to each other from the opposite ends of the coupling portion 9. The latch 4 is a one-piece molding of a resin having adequate elasticity and rigidity, e.g., POM (polyoxymethylene). Although in this embodiment the arm portions 10 extend substantially parallel to each other from the opposite ends of the coupling portion 9, it is possible to provide the arm portions 10 such that they extend obliquely outwardly, i.e., away from each other, or obliquely inwardly, i.e., toward each other.

The arm portions 10 respectively have guide portions 12 formed at their ends and extending away from each other toward the free ends. At their ends opposite the free ends, the guide portions 12 terminate in lock shoulders 13 to be engaged with and having a complementary shape with respect to the lock shoulders 8 of the striker 3. The latch 4 further has a projection 14 projecting for a small length from the rear surface of the coupling portion 9 into a space defined between the two support leg portions 11. The support leg portions 11 respectively have pawl portions 15. These pawl portions 15 have opposed inner surfaces 15' which extend away from each other in the outward direction.

Reference numeral 16 designates a mounting frame, via which the latch 4 is mounted in the housing 1. The mounting frame 16 includes a plate-like flange portion 18 having a central rectangular through window 17, a pair of support pieces 19 extending rearwardly and parallel to each other from opposed edges of the window 17 and a rectangular connecting piece 20 connecting the central portions of ends of the support pieces 19. Like the striker 3, the mounting frame 16 may be a one-piece molding of a resin having a comparatively high rigidity, e.g., ABS.

Now, the procedure of assembly of the striker 3, latch 4 and mounting frame 16 having the structures as described above will be described. First, the housing 1 is formed with a square through hole 21 in which the two support pieces 19 of the mounting frame 16 are to be inserted. As shown in FIG. 1, the housing 1 is also formed with a recess 22 which surrounds the through hole 21, and in which the flange portion 18 of the mounting frame 16 is snugly fitted.

Next, the latch 4 is mounted in the mounting frame 16 before the mounting frame 16 is secured to the housing 1. Alternatively, the mounting frame 16 is secured to the housing 1 before mounting the latch 4 in the mounting frame 16. Here, the former procedure will be described.

The support leg portions 11 of the latch 4 are rearwardly inserted through the window 17 at the front side of the housing of the mounting frame 16 so that the connecting piece 20 is fitted in the space between the support leg portions 11. As a result, the support leg portions 11 of the latch 4 are engaged with the connecting piece 20 in the depth of the window 17.

Subsequently, the latch 4 is further pushed strongly to bring the inner surfaces 15' of the pawl portions 15 into contact with the outer surfaces of the connecting piece 20. When the latch 4 is pushed, the two support leg portions 11 are pushed away from each other by the outer surfaces of the connecting piece 20, and the connecting piece 20 is fitted in the space between the two support leg portions 11. When the front surface of the connecting piece 20 strikes the projection 14 projecting rearwardly from the coupling portion 9, the two support leg portions 11 are brought toward each other to their original positions by their elastic restoring force. Thus, the rear ends of the two pawl portions 15 are snapped against the rear surface of the connecting piece 20 such that the latch 4 can no longer be retreated, and the connecting piece 20 is clamped between the two support leg portions 11.

After the latch 4 has been mounted in this way, the two support pieces 19 of the mounting frame 16 are inserted rearwardly through the through hole 21 of the housing 1, then the flange portion 18 is disposed in the recess 22, and the mounting frame 16 is secured by screws or with an adhesive to the housing 1.

Meanwhile, the striker 3 has its base portion 5 secured by means of a screw to the door 2. Thus, the projecting portion 6 of the striker 3 projects rearwardly from the back side of the door 2 such that it faces the window 17 of the mounting frame 16.

Now, the operation of the locking device when opening and closing the door 2 will be described.

First, when the door 2 is closed from its open state, the projecting portion 6 of the striker 3 is inserted through the window 17 of the mounting frame 16 and comes in contact with the arm portions 10 of the latch 4 in the window 17. Since the door 2 is hinged to the housing 1, the striker 3 advances into the window 17 of the mounting frame 16 describing an arcuate line with a pivotal point (not shown) as a fulcrum (FIG. 1).

When the door 2 is closed strongly, the end portion 7 of the striker 3 is brought into engagement with the guide portions 12 of the latch 4, and as the end portion 7 advances into the space between the two arm portions 10 of the latch 4, the two arm portions 10 are gradually forced apart outwardly.

Figure 4:
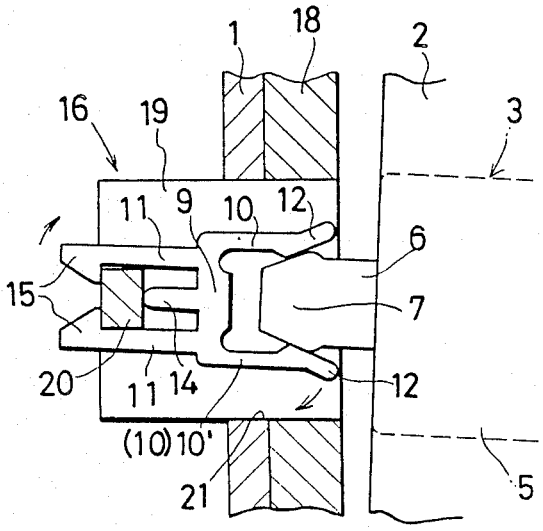
FIG. 4 is a side view showing the striker in the locking device shown in FIG. 1 in a state inserted into the latch.

At this time, the striker 3 is inserted obliquely. Therefore, the inner side arm portion (indicated by numeral 10' in FIG. 4) nearer the pivotal point (not shown) of the door 2 is strongly pushed by the end portion 7 to be turned outwardly slightly greatly. Therefore, a clockwise moment about the connecting piece 20 acts on the latch 4. Since the support leg portions 11 have flexibility, the latch 4 is slightly rotated clockwise in the window 17 of the mounting frame 16 about the end of the projection 14 in point contact with the rear surface of the connecting piece 20 to cause the direction of the arm portions 10 to align with the direction of insertion of the striker 3.

Thus, the striker 3 advances into the space between the two arm portions 10 in a direction substantially parallel thereto while changing the orientation of the arm portions 10 to follow the insertion direction of the striker 3.

With the advance of the striker 3, the latch 4 and striker 3 are gradually brought to be parallel to each other. The two arm portions 10 are thus evenly pushed by the end portion 7, and the latch is gradually turned backwards by the elastic restoring force of the two arm portions 10 and two support leg portions 11.

When the end portion 7 of the striker 3 thus clears the lock shoulders 13 of the two arm portions 10, the latch 4 is returned to be parallel to the window 17 of the mounting frame 16. At this time, the two arm portions 10 of the latch 4 are brought to be closer to their original positions by their elastic restoring force. The two lock shoulders 13 are thus snap-engaged with the lock shoulders 8 of the striker 3, so that the end portion 7 of the striker 3 is held clamped between the two arm portions 10 of the latch 4, as shown by an imaginary line in FIG. 1.

Thus, the door 2 is locked at a position to close the opening (not shown) of the housing 1 by the latch 4.

To open the locked door 2, a grip (not shown) thereon is gripped and strongly pulled forwardly. As a result, the two arm portions 10 of the latch 4 are forced apart outwardly, thus releasing the end portion 7 of the striker 3. Subsequently, the door 2 can be opened with a comparatively light force.

When the door 2 is opened, the striker 3 again traces the arcuate line, so that the latch 4 is turned about the connecting piece 20 of the mounting frame 16 to hold its angle with respect to the striker 3 zero, i.e., to be parallel with the striker 3. For this reason, the two arm portions 10 of the latch 4 are opened evenly and closed evenly by their elastic restoring force. The striker 3 thus can be released smoothly.

In the illustrated embodiment described above, the pair of support leg portions 11 are provided on the latch 4 while the connecting piece 20 clamped between the two support leg portions 11 is provided on the mounting frame 16. However, it is possible to provide a connecting piece on the latch 4 while providing support leg portions on the mounting frame 16. Further, it is possible to omit the mounting frame 16 and mount the latch 4 directly on the housing 1. In this case, a connecting piece or support leg portions may be provided on the housing 1.

Further, the latch 4 need not be a one-piece member; for instance, it is possible to employ a socalled floating type latch having a mechanical action as disclosed in the U.S. Pat. Nos. 4,657,291 or 4,709,949 cited before as prior art. The floating type latch noted above has a structure comprising a hollow case having a front opening, a slide having a pair of arm portions like those in the above embodiment for snappedly holding a striker, biasing means consisting of a coil spring or the like for biasing the slide in a direction to project from the opening of the case, and lock means utilizing a heart-shaped cam groove or a rotary cam for locking the slide at a retreated position in the case and releasing the slide from the locked state when the slide is further pushed by the striker. When using this floating type latch, the slide may be accommodated slightly rotatably within the case, or the case itself may be mounted rotatably with respect to a housing, whereby the same effects as in the above embodiment can be obtained.

Further, while in the above embodiment the elastic restoring force of resin has been utilized for the backward turning of the latch, it is also possible to utilize the restoring force of a spring or the like to this end.

As has been described in the foregoing, since the door or lid or like openable wall is hinged to a housing, even if the striker is inserted obliquely into the latch, the deviation of the direction of insertion into the latch can be compensated for by a rotation of the latch relative to the housing. It is thus possible to provide a locking device which permits smooth engagement between the latch and the striker, is less liable to erroneous holding of the striker and is highly reliable.

What is claimed is:

1. A locking device comprising a striker projecting from the back side of an openable wall hinged to a housing and a latch secured in a frontally inserted snap-fit engagement to the housing in a face-to-face relation to said striker for engaging with said striker and holding said striker in a snap-engaged state when said openable wall is closed, said latch including means for rotatably mounting said latch in said housing to be able to follow the direction of insertion of said striker into said latch, said means including resiliently flexible arm means snapped into engagement with a mounting portion on said housing as said arm means are inserted through a window in a front side of said housing, said arm means permitting pivotal movement of said latch relative to said housing during insertion of the striker into said latch.

2. The locking device according to claim 1, wherein said latch is substantially H-shaped and has a pair of first arm portions extending forwardly from a coupling portion and a pair of second arm portions extending rearwardly from said coupling portion, said second arm portions providing said resiliently flexible arm means serving to hold a mounting frame of said housing.

3. A locking device according to claim 2 wherein said latch is a single piece integrally formed of plastic.

4. The locking device according to claim 1, wherein said latch is substantially H-shaped and has a pair of first arm portions extending forwardly from a coupling portion and a pair of second arm portions extending rearwardly from said coupling portion, said first arm portions serving to hold said striker, said second arm portions providing said resilient flexible arm means serving to hold a mounting frame of said housing, a rearwardly protruding projection is formed between and generally parallel to said second arm portions for pivotally engaging a connecting portion of said mounting frame providing a pivotal fulcrum about which said latch rotates.

* * * * *

UNITED STATES PATENT AND TRADEMARK OFFICE

CERTIFICATE OF CORRECTION

PATENT NO. : 4,881,764

DATED : November 21, 1989

INVENTOR(S) : Atsushi Takahashi and Haruhiko Watari

It is certified that error appears in the above-identified patent and that said Letters Patent is hereby corrected as shown below:

Column 6, Line 10 "from said coupling portion, said second arm portions" to -- from said coupling portion, said first arm portions serving to hold said striker, said second arm portions --

Signed and Sealed this

Fourth Day of August, 1992

*Attest:*

*Attesting Officer*

DOUGLAS B. COMER

*Acting Commissioner of Patents and Trademarks*